US005174220A

United States Patent [19]

Skedeleski et al.

[11] Patent Number: 5,174,220

[45] Date of Patent: Dec. 29, 1992

[54] SURFBOARD PROTECTIVE TIP

[75] Inventors: David Skedeleski; Eric Arakawa, both of Aiea, Hi.

[73] Assignee: Surfco, Aiea, Hi.

[21] Appl. No.: 287,975

[22] Filed: Dec. 20, 1988

Related U.S. Application Data

[63] Continuation-in-part of Ser. No. 37,190, Apr. 10, 1987, Pat. No. 4,792,316.

[51] Int. Cl.[5] ..... A63C 15/05

[52] U.S. Cl. ..... 114/219; 441/74

[58] Field of Search ..... 441/74; 114/219

[56] References Cited

U.S. PATENT DOCUMENTS 3,374,495 3/1968 Joyce ..... 114/219

4,792,316 12/1988 Skedelski et al. ..... 441/74

*Primary Examiner*—Sherman D. Basinger

*Assistant Examiner*—Thomas T. Brahan

*Attorney, Agent, or Firm*—Nixon & Vanderhye

[57] ABSTRACT

A protective tip cover for the sharply angled nose portion of a surfboard for reducing or preventing injury to the user upon impact with the nose portion of the board. Tip covers may be used for any type of surfboard, including those used for wind surfing. The cover comprises a relatively soft, resilient (e.g., silicone), generally V-shaped member provided with a gently rounded apex portion and a pair of rearwardly extending wing portions which merge into side surfaces of the board. Where used with a wind surfing surf board, the tip cover has a substantially flat bottom and gradually curved top. Upper and lower surfaces of the board may be provided with slots extending from the juncture of the wing portions toward the apex. An after market kit is also provided for enhancing the safety of existing boards. The kit includes a surfboard tip cover, suitable primer and adhesive, applicators and installation instructions.

18 Claims, 2 Drawing Sheets

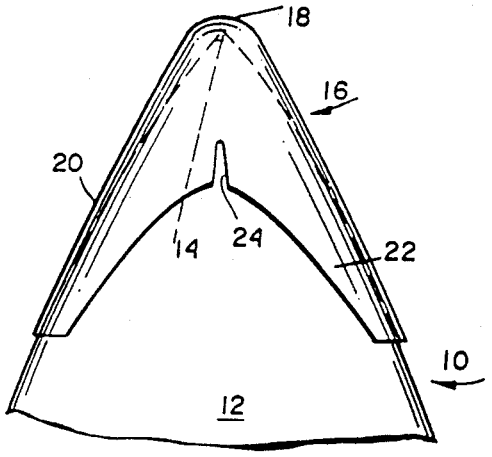
FIG. 1
FIG. 5
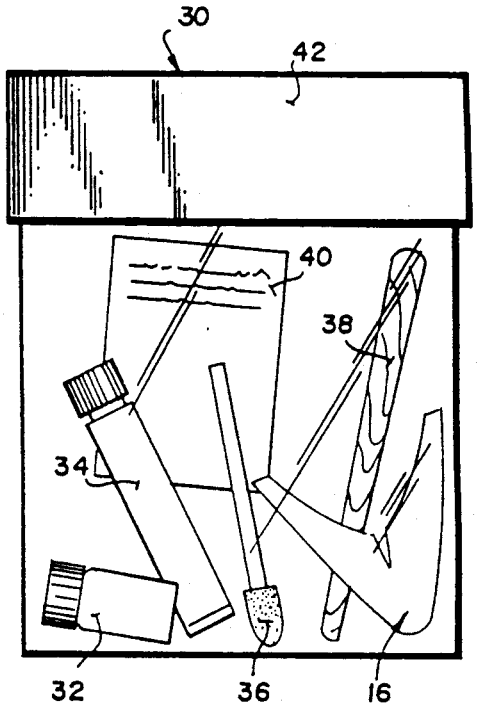
FIG. 3
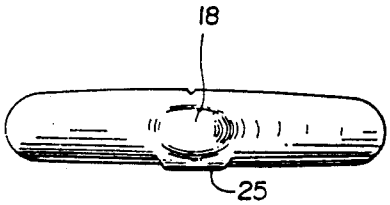
FIG. 2
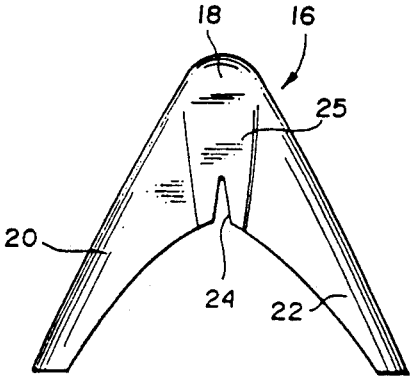
FIG. 4
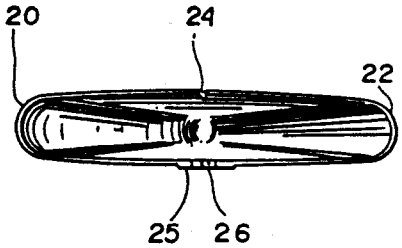

SURFBOARD PROTECTIVE TIP

CROSS REFERENCE TO RELATED APPLICATION

This application is a continuation in part of our application Ser. No. 07/037,190 filed Apr. 10, 1987, now U.S. Pat. No. 4,792,316 issued Dec. 20, 1988.

BACKGROUND AND SUMMARY OF THE INVENTION

This invention relates to a safety device for surfboards, and specifically to a relatively soft protective covering member for the forward tip of a surfboard, and, in a related aspect, to a safety enhancing kit enclosing a protective tip cover along with suitable means for attaching the cover to a surfboard. The invention is applicable to a wide variety of surfboards, including boards used for wind surfing, which have a sail controlled by a user standing on the board and moving the sail in several dimensions of movement.

Contemporary short surfboards, and surfboards used for wind surfing, have sharply pointed forward tips which can seriously or fatally injure the user of the board upon loss of control of the board during surfing. Typically, after falling or being thrown from a board, the surfer is exposed to substantial danger from the board itself as the latter is tossed about by the enormous amount of energy generated by ocean waves or the like. The hazard may be made worse if the practice of tying the board to the user's ankle to keep the board in the immediate area of the user, so that the board need not be located and retrieved after each so called "wipeout", is practiced.

Despite the obvious and substantial safety hazard presented by these contemporary boards, surfers have resisted attempts to make the boards safer through rounding of the tip or nose portion thereof. This invention provides an alternative safety measure which substantially retains the appearance and performance characteristics of the board, while providing a needed measure of safety for the user. In the present invention, a surfboard tip cover is provided which comprises a generally hollow, substantially V-shaped member which is made of a relatively soft, flexible and resilient silicone material. The device is adapted to fit over the sharply pointed boards and to present an only slightly rounded, yet effective cushion at the tip of the board.

The V-shaped cover may be further characterized in that notch-like slots are provided on upper and lower surfaces of the cover at the juncture between the main body or tip portion and rearwardly extending wing portions thereof which merge into the side surfaces of the board. These slots allow the device to be effectively applied to boards of slightly different sizes and shapes. Different sizes are utilized for boards having significantly different dimensions (e.g. for wind surfing surfboards as opposed to conventional surfboards without sails). The tip cover is designed to be permanently adhered to the tip of the surfboard through the use of suitable means such as silicone adhesive.

The tip cover itself is preferably made of a liquid injected silicone having a durometer A hardness of between about 35 and 40, a tensile strength of about 1000 psi and a tear resistance, Die B, of about pi 175. The rearwardly extending wing portions of the device are feathered along the inside edges thereof to insure smooth merging into the adjacent surfaces of the board.

When employed on wind surfing surfboards, the tip cover has straighter inside wings, and the inside and outside radius of the wings is not round top and bottom, the top being more gradually curved, and the bottom being substantially flat.

A further aspect of the invention is the provision for a complete "after market" kit for increasing the safety of existing surfboards. The kit itself includes a tip cover of the type described above, adhesive means including a priming liquid and a silicone adhesive, a primer applicator and an adhesive applicator. Also included in the kit may be suitable instructions for attaching the tip cover to the surfboard.

Further objects and advantages of the invention will become apparent from an inspection of the drawings and detailed description of the invention which follows.

BRIEF DESCRIPTION OF THE DRAWINGS

FIG. 1 is a perspective view of the forward portion of a surfboard having a tip cover in accordance with this invention attached thereto;

FIG. 2 is a plan view of a tip cover in accordance with an exemplary embodiment of this invention, illustrating the side opposite that shown in FIG. 1;

FIG. 3 is a front view of the tip cover disclosed in FIG. 2;

FIG. 4 is a rear view of the tip cover disclosed in FIG. 2;

FIG. 5 is a perspective view of a kit in accordance with the exemplary embodiment of this invention;

DETAILED DESCRIPTION OF THE INVENTION

Figure 6:
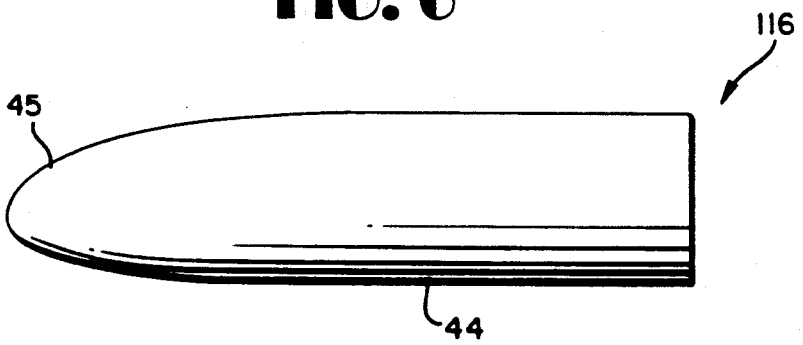
FIG. 6 is a side elevational view of another embodiment of tip cover according to the invention, specifically designed for wind surfing surfboards.

Referring to FIG. 1, there is illustrated a forward deck portion of a surfboard to which a tip cover in accordance with this invention has been attached. The surfboard 10 is of the contemporary, short type which typically includes a forward portion 12 having a sharply angled nose or tip 14. It is readily apparent that this sharply pointed nose or tip poses a significant safety hazard to anyone coming into contact with the board, either in the water or out. The board is particularly dangerous to the user upon loss of control of the board while surfing. The force of ocean waves propelling a board into contact with a momentarily defenseless user of the board can cause serious and even fatal injury.

The invention here relates to the attachment of a tip cover 16 to the tip 14 of the board 12. The cover has a generally V-shaped configuration wherein the apex of the V is gently rounded at 18. Legs or wing portions 20, 22 extend rearwardly from the apex portion 18 of the device.

As best seen in FIGS. 1 and 4, the tip cover 16 is substantially hollow, each of the rearwardly extending wing portions 20, 22 being formed with a generally trough-like shape so as to partially wrap around and merge into the side edges of the board.

At the juncture of the rearwardly extending wing portions, on both upper and lower surfaces of the cover, notch-like slots 24, 26 are provided to permit the cover to be fitted to boards of slightly different shapes and sizes. As best seen in FIG. 2, additional material may be added to the lower side of the cover in the form of a reinforced portion 25 extending from adjacent the slot 26 and merging into the nose area 18.

The tip cover is preferably constructed of a flexible and resilient liquid injected silicone, having a hardness on the durometer A scale of 35 to 40, a tensile strength of about 1,000 psi, and a tear resistance, Die B, of about pi 175.

The tip cover is preferably applied to the nose or top of a surfboard with a suitable adhesive. In this regard, it is to be understood that the tip of the surfboard need not fit all the way into the tip cover. In fact, pushing the tip into too far may cause distortion of the cover. It is preferable that any space left between the tip of the board and the apex of the cover be filled with the silicone adhesive to provide an even further cushioning effect.

In applying the tip cover to a sharply angled nose portion of a surfboard, it is necessary to first clean the nose area of the board of all wax, sand, dust, etc. It will be understood, of course, that any sharp or rough points on the tip of the surfboard should be removed, as by sanding, etc. Once cleaned, a clear liquid primer is applied to the nose area of the board, and to the inside of the tip cover. Typical primers will dry in about one minute. It will be appreciated that the primer is necessary to promote adherence of the tip cover to the board. A suitable adhesive, such as a silicone glue is subsequently applied inside the tip cover and spread about the inside surface thereof with a suitable applicator. The tip cover is then pushed onto the tip of the board and any excess, exposed adhesive may be wiped away with a cloth or with the applicator. If desirable, masking tape may be used to hold the tip cover in place while the adhesive cures. Curing should be allowed to take place over approximately a twenty-four hour period.

Turning now to FIG. 5, there is illustrated an after market safety enhancing kit in accordance with another aspect of the invention. In FIG. 5, a substantially transparent plastic bag 30 is shown which encloses a tip cover 16 of the type described hereinabove, primer material 32, adhesive 34, a primer applicator 36, and an adhesive applicator 38. Promotional material 40 may also be enclosed if desired. The bag 30 may also be provided along its upper surface with a suitable closure 42, preferably of lightweight cardboard, which may include instructional material printed thereon, although an instruction sheet may be included as part of the promotional material 40 or as a separate sheet inserted in the bag if so desired.

Figure 7:
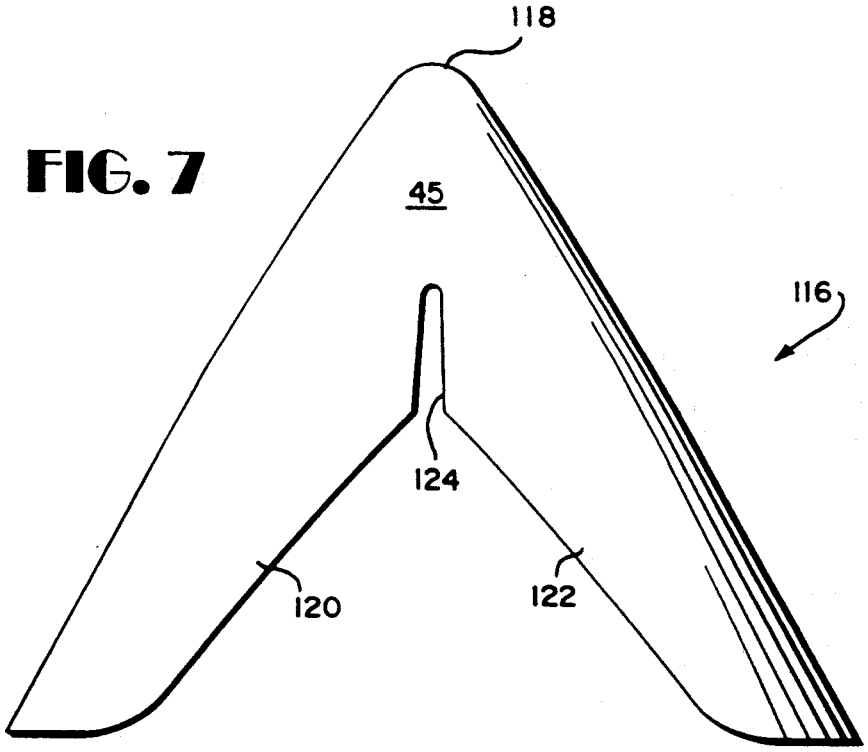
FIG. 7 is a top plan view of the tip cover of FIG. 6.
Figure 8:
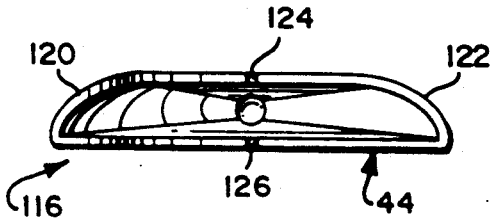
FIG. 8 is an end view of the tip cover of FIG. 6, looking into the open ends of the wings.

FIGS. 6–8 illustrate another embodiment of the tip cover according to the invention for use with a surfboard of the type used in wind surfing, or for a like water-sport board. In this embodiment portions and structures corresponding in function to those in the FIGS. 1–4 embodiment are illustrated by the same reference numeral only proceeded by a "1".

The tip cover 116 is shown in actual size in FIGS. 6 and 7 for use on a wind surfing type surfboard. It is larger than the FIGS. 1–4 embodiment cover 16. It includes rounded tip 118, wings 120, 122, and preferably notches 124, 126. Note that the bottom 44 thereof is substantially flat, while the top 45 has a curve more gradual than that of the tip cover 16. Also note that the insides of the wings 120, 122 are straighter than for the FIGS. 1–4 embodiment.

The tip cover 116 may be made of the same material as the cover 16, i.e. silicone of the indicated durometer, and may be provided in kit form as illustrated for the cover 16 in FIG. 5.

It will thus be appreciated that the invention provides an effective measure of safety for otherwise hazardous surfboards in the form of a relatively inexpensive, and easily attached tip cover which serves to blunt or cushion the impact of the board and thereby reduce the chances of serious injury which might otherwise occur. The tip cover does not adversely alter the overall appearance or performance characteristics of the board, whether used for surfing, wind surfing, or like water sports, and can be color matched or contrasted as desired.

While the invention has been described in connection with what is presently considered to be the most practical embodiment, it will be apparent to those of ordinary skill in the art that many changes and variations may be made which nevertheless remain within within the spirit and scope of the appended claims.

What is claimed is:

1. In combination with a surfboard of the type having a sharply angled forward tip portion, means for affording protection to the user of the surfboard from injury upon contact with said tip portion while not adversely altering the performance characteristics of the surfboard, said means comprising a relatively soft, resilient, silicone tip cover of generally V-shaped configuration, having a rounded exterior nose portion and rearwardly extending, substantially trough-shaped wing portions, said tip cover being fixedly secured to said tip portion of said surfboard.

2. The combination as defined in claim 1 wherein said tip cover is constructed of a liquid injected silicone material and wherein said tip cover is secured to said surfboard with silicone adhesive.

3. The combination as defined in claim 2 wherein said tip cover has a durometer A hardness of about 35 to 40, a tensile strength of about 1,000 psi and a tear resistance, Die B, of about 175 psi.

4. The combination as defined in claim 1 wherein said tip cover is for use with a wind surfing surfboard, and wherein said tip cover has a substantially flat bottom.

5. The combination as defined in claim 1 wherein said tip cover is for use with a wind surfing surfboard, and wherein said tip cover has a substantially flat bottom, and a gradually downwardly curved top portion terminating in said flat bottom.

6. A protective tip cover for the forward tip of a surfboard for wind surfing, comprising a soft, resilient generally V-shaped cushioning member for affording protection to the user of the surfboard during surfing without adversely affecting the performance characteristics of the board, having a rounded exterior nose portion and a pair of rearwardly extending wing portions, said tip cover having a first, substantially flat bottom terminating in a peripheral edge, and a second, top, curving gradually downwardly to the peripheral edge.

7. A protective tip cover as defined in claim 6 wherein said member is constructed of a liquid injected silicone material.

8. A protective tip cover as defined in claim 7 wherein said member has a durometer A hardness of about 35 to 40.

9. A protective tip cover as defined in claim 6 wherein said wing portions intersect at a juncture defined by slot means, and wherein each of said wing portions has a thickness which decreases toward the edges thereof.

10. A kit for improving the safety of surfboards used for wind surfing and having sharply pointed forward tip portions comprising:

(a) a soft, resilient tip cover for attachment to the tip of a surfboard used for wind surfing, said tip cover having a rounded, cushioning nose, a first substantially flat bottom portion terminating in a peripheral edge, wing portions extending from said nose, and a second top portion gradually curving downwardly to the peripheral edge;

(b) adhesive means for attaching said tip cover to the tip of a surfboard; and (c) means for applying said adhesive means to said surfboard and said tip cover.

11. A kit as defined in claim 10 wherein said adhesive means comprises a primer and an adhesive.

12. A kit as defined in claim 10 wherein said tip cover is constructed of a liquid injected silicone.

13. A kit as defined in claim 12 wherein said adhesive comprises silicone adhesive.

14. A kit as defined in claim 12 wherein said member has a durometer A hardness of about 35 to 40, a tensile strength of about 1,000 psi, and a tear resistance, Die B, of about pi 175.

15. A protective tip cover for the forward tip of a surfboard for wind surfing, comprising a soft, resilient generally V-shaped cushioning member for affording protection to the user of the surfboard during surfing without adversely affecting the performance characteristics of the board, having a rounded exterior nose portion and a pair of rearwardly extending wing portions, said tip cover having a substantially flat bottom, and a gradually curved top; and wherein said wing portions intersect at a juncture defined by slot means, and wherein each of said wing portions has a thickness which decreases toward the edges thereof.

16. A protective tip cover as recited in claim 15 wherein said member is constructed of silicone.

17. A protective tip cover as recited in claim 16 wherein said member has a durometer A hardness of about 35–40.

18. A protective tip cover as recited in claim 17 wherein said member has a tensile strength of about 1,000 psi, and a tear resistance, Die B, of about pi 175.

* * * * *